US012044428B2

(12) United States Patent
White

(10) Patent No.: US 12,044,428 B2
(45) Date of Patent: Jul. 23, 2024

(54) QUICK FLEX DUCT CONNECTIONS AND SYSTEM

(71) Applicant: 1236220 B.C. LTD., Mission (CA)

(72) Inventor: Keith R. White, Mission (CA)

(73) Assignee: 1236220 B.C. LTD., Mission (CA)

( * ) Notice: Subject to any disclaimer, the term of this patent is extended or adjusted under 35 U.S.C. 154(b) by 0 days.

(21) Appl. No.: 17/809,966

(22) Filed: Jun. 30, 2022

(65) Prior Publication Data

US 2023/0003416 A1 Jan. 5, 2023

Related U.S. Application Data

(60) Provisional application No. 63/217,311, filed on Jul. 1, 2021.

(51) Int. Cl.
*F24F 13/02* (2006.01)

(52) U.S. Cl.
CPC ..... *F24F 13/0209* (2013.01); *F24F 13/0218* (2013.01); *F24F 13/0245* (2013.01); *F24F 13/0263* (2013.01)

(58) Field of Classification Search
CPC ..... F24F 13/0209; F24F 13/0218; F24F 13/0245; F24F 13/0263
USPC ..... 138/109
See application file for complete search history.

(56) References Cited

U.S. PATENT DOCUMENTS 3,596,936 A 8/1971 Dieckmann et al.
3,676,986 A * 7/1972 Reiling ..... A47L 5/38 15/327.2
3,819,209 A 6/1974 Anderson et al.
3,874,024 A * 4/1975 Ford ..... A47L 9/2857 285/7
3,915,477 A 8/1975 Timmons
4,099,747 A 7/1978 Meserole
4,930,815 A 6/1990 Tuggler, Jr.
5,609,370 A * 3/1997 Szabo ..... F16L 37/0985 285/921
6,539,920 B1 * 4/2003 Spiers ..... F02M 69/465 123/456
7,338,095 B1 3/2008 Karnes
7,393,021 B1 7/2008 Lukjan
7,523,964 B2 4/2009 Sandman et al.
8,328,244 B2 * 12/2012 Johnson ..... F16L 37/098 285/305
9,689,108 B2 6/2017 Hamman, Jr. et al.
10,422,458 B2 9/2019 Smith et al.
10,456,547 B2 * 10/2019 Miller ..... A61M 39/1055
10,781,947 B2 * 9/2020 Fetchko ..... F16L 5/10
2003/0236015 A1 * 12/2003 Edirisuriya ..... A61M 16/16 439/191

(Continued)

FOREIGN PATENT DOCUMENTS

CA 2733871 C 1/2014

*Primary Examiner* — David R Deal
(74) *Attorney, Agent, or Firm* — FisherBroyles, LLP; Susan M. Oiler

(57) ABSTRACT

Flex duct systems have a flex duct having a wire-reinforced core and first and second hollow connector ends threaded to one each of ends of the wire-reinforced core. Each connector end has a plurality of locking tabs. A boot, a saddle trunk, or a linking connector each have a plurality of sleeves each protruding radially outward and positioned to releasably, attachably receive one of the plurality of locking tabs for a fluid tight connection therewith.

18 Claims, 4 Drawing Sheets

(56) References Cited

U.S. PATENT DOCUMENTS

| | | | | |
|---|---|---|---|---|
| 2005/0144754 | A1* | 7/2005 | Ivarsson | A47L 9/242 15/327.2 |
| 2006/0016045 | A1* | 1/2006 | Proud | A47L 9/244 15/414 |
| 2010/0201116 | A1 | 8/2010 | Kipker et al. | |
| 2014/0130892 | A1* | 5/2014 | Mantyla | A47L 5/38 439/190 |
| 2017/0347849 | A1* | 12/2017 | Majer | A47L 7/0095 |
| 2020/0217553 | A1 | 7/2020 | Quinn et al. | |

* cited by examiner

QUICK FLEX DUCT CONNECTIONS AND SYSTEM

RELATED APPLICATIONS

This application claims the benefit of U.S. Provisional Application No. 63/217,311, filed Jul. 1, 2021, which is incorporated herein by reference in its entirety.

TECHNICAL FIELD

The invention relates to flex duct systems for heating, ventilation, and air conditioning (HVAC) systems, more particularly, releasably, attachable duct connectors and duct connection systems.

BACKGROUND

In the heating and cooling industry, there are many ways of heating/cooling air for domestic and commercial buildings. The traditional method is a furnace, ventilation, and air conditioning systems that have ductwork leading therefrom to the various rooms in a building. The ductwork in a residential building or home typically is arranged in a trunk and branch configuration. A plenum or trunk conveys air from an air handler of a HVAC system through various ducts and distribution boxes to smaller branch ducts that carry air to individual rooms of the home. Many ducts, particularly trunk ducts and plenums, are formed of sheet metal and are rigid. Rigid ducts can be made from a wide variety of materials, such as, for example, sheet metal, duct board, foam board, or any other suitably rigid material. Larger ducts and distribution boxes may be formed of duct board, a rigid insulating material formed of an insulation layer and a reinforcing layer. Branch ducts may be rigid sheet metal ducts or flexible ducts.

Flexible ducts are typically formed of a wire-reinforced core, an insulation layer, and an outer sheath. Typically, flex (flexible) ducts begin from a connector at a trunk duct, plenum, or rigid duct branch and terminate at duct boots that connect the ducts to air registers or vents arranged in the floor, walls, or ceiling of a room. Existing methods of connecting flexible ducts to rigid ducts made of stainless or galvanized steel or duct board include sheet metal screws, mastic, adhesive tape, and plastic ties. These methods may be used on their own or in concert to connect ducts together. Mastic is a non-hardening adhesive compound that may be used on its own or with a reinforcing material such as fiberglass mesh tape.

There is a need for a flex duct system that is easy to use, has a quick connect attachment at both ends of the flex duct that is securely yet releasably attachable thereto, saves the installer time, and is securely yet releasably attachable to duct boots.

SUMMARY

In one aspect, flex duct systems are disclosed that have a flex duct having a wire-reinforced core and first and second hollow connector ends threaded to one each of ends of the wire-reinforced core. Each connector end has a plurality of locking tabs. Also, the system includes a boot, a saddle trunk, or a linking connector having a plurality of sleeves each protruding radially outward and positioned to releasably, attachably receive one of the plurality of locking tabs for a fluid tight connection. The plurality of locking tabs partially define the body of each of the first and second connector ends. Each of the plurality of locking tabs has a free end forming a detent and an arm potion immediately adjacent to the detent that is sized and shaped to fit inside one of the plurality of sleeves after the detent has passed through the one of the plurality of sleeves. Each of the plurality of locking tabs has a grip portion most proximate a fixed end thereof, and each of the plurality of locking tabs is configured to flex inward toward a central longitudinal axis when pressure is applied to the grip portion thereof.

In all embodiments, the interior surface of the body of each of the first and second connector ends can have a plurality of spaced apart longitudinal ribs that terminate at an inward protruding shoulder. And, the boot, the saddle trunk, or the linking connector are each insertable into one of the connector ends of the flex duct until seated on the inward protruding shoulder.

In all embodiments, the linking connector has a first plurality of sleeves most proximate a first end thereof and a second plurality of sleeves most proximate a second end thereof.

In all embodiment, the saddle trunk can be fixedly attached to a prefabricated trunk, plenum, or duct.

In a second aspect, kits are disclosed that have a flex duct having a wire-reinforced core with a first end and a second end, first and second hollow connector ends each having a threaded end configured to receive one of the first end and second end of the wire-reinforced core of the flex duct, respectively, and a locking end having a plurality of locking tabs, a boot, a saddle trunk, or a linking connector having a plurality of sleeves each protruding radially outward and positioned to releasably, attachably receive one of the plurality of locking tabs for a fluid tight connection to one of the first or second hollow connector ends.

When a saddle trunk is included in the kit it can be fixedly attached to a prefabricated trunk, plenum, or duct. When a boot is included in the kit it can have a 90° elbow and a vent insert.

In all embodiment, the flex duct can have an insulation layer juxtaposed to the wire-reinforced core and an outermost sheath.

In all embodiments, the plurality of locking tabs can partially define the body of each of the first and second connector ends. Each of the plurality of locking tabs has a free end forming a detent and an arm potion immediately adjacent to the detent that is sized and shaped to fit inside one of the plurality of sleeves after the detent has passed through the one of the plurality of sleeves. Moreover, each of the plurality of locking tabs can have a grip portion most proximate a fixed end thereof. Each of the plurality of locking tabs is configured to flex inward toward a central longitudinal axis when pressure is applied to the grip portion thereof.

In a third aspect, methods for installing a flex duct system are disclosed that include providing a kit as described herein, determining a length of the flex duct needed for connecting the flex duct to one of an installed boot or saddle trunk, cutting the flex duct to the length, threading a first end of the wire-reinforced core on to a first connector end, threading a second end of the wire-reinforced core on to the second connector end, and connecting the first connector end to the boot or saddle trunk and the second connector end to another boot, saddle trunk, or linking connector by sliding the first and second end connectors onto the boot, saddle trunk, or linking connector with the plurality of locking tabs inserted into the plurality of sleeves. Typically, threading the first end of the wire reinforced core on to the first end connector occurs before determining a length of the flex duct.

DETAILED DESCRIPTION

Figure 1:
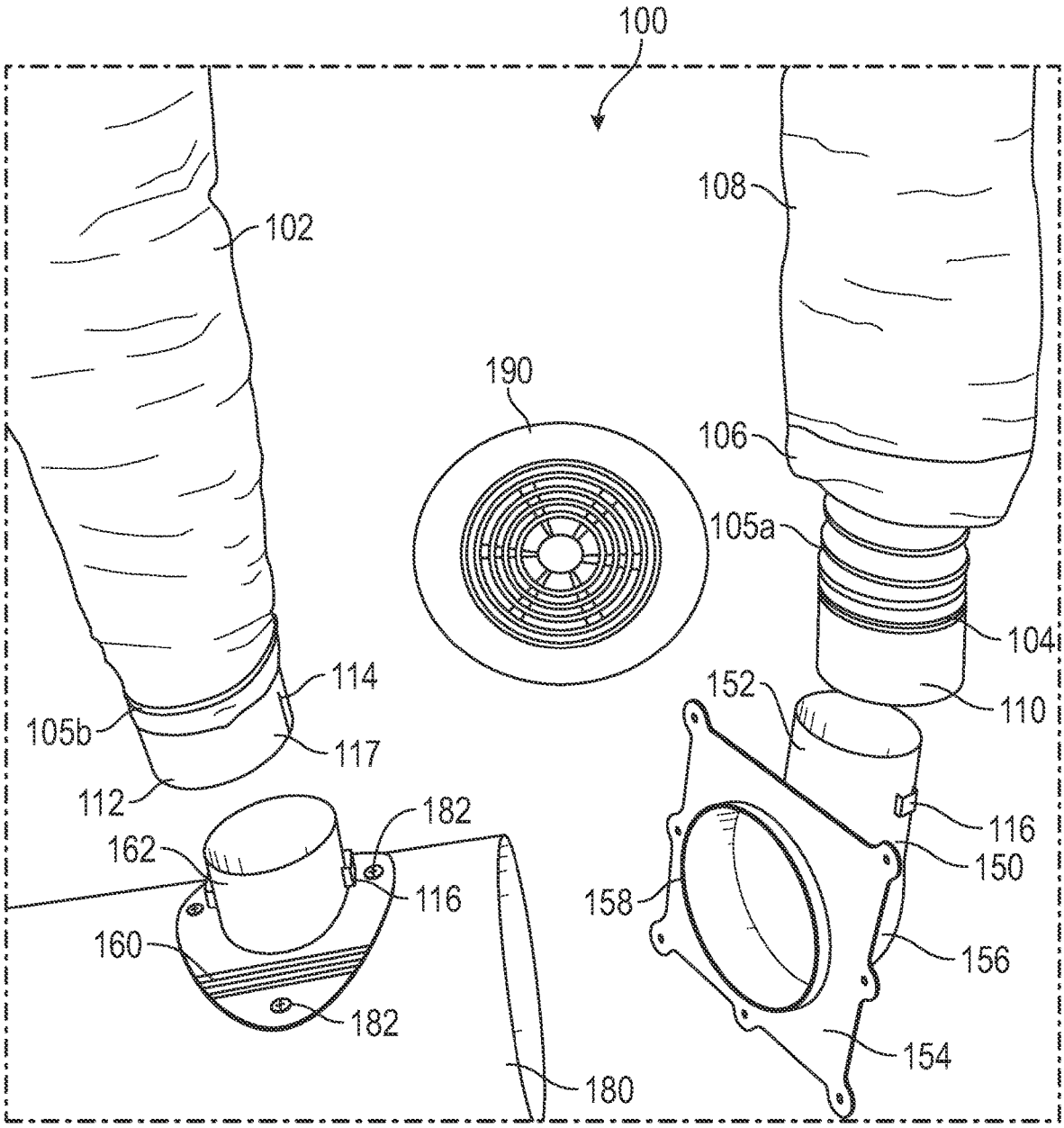
FIG. 1 is a perspective view of a flex duct system in an unconnected state.

The following detailed description will illustrate the general principles of the invention, examples of which are additionally illustrated in the accompanying drawings. In the drawings, like reference numbers indicate identical or functionally similar elements.

Referring to FIG. 1, a flex duct system 100 is shown as having a flex duct 102, which includes a wire-reinforced core 104, an insulating layer 106 typically in direct contact with the wire-reinforced core 104, and an outermost sheath 108, first and second hollow connector ends 110, 112 threaded to one each of ends 105*a*, 105*b* of the wire-reinforced core 104, and a boot 150, saddle trunk 160, or linking connector 170 (FIG. 4) that are replaceably attachable to the first and second hollow connector ends 110, 112. Each of the first and second connector ends 110, 112 have a plurality of locking tabs 114 in a female receiving end 117 thereof, and the boot 150, saddle trunk 160, and linking connector 170 each have a plurality of sleeves 116 each protruding radially outward and positioned to releasably, attachably receive one of the plurality of locking tabs 114 for a fluid tight connection when a male end 152, 162, 172 thereof is slide into the female receiving end 117 of any of the first and second connector ends 110, 112.

Figure 3:
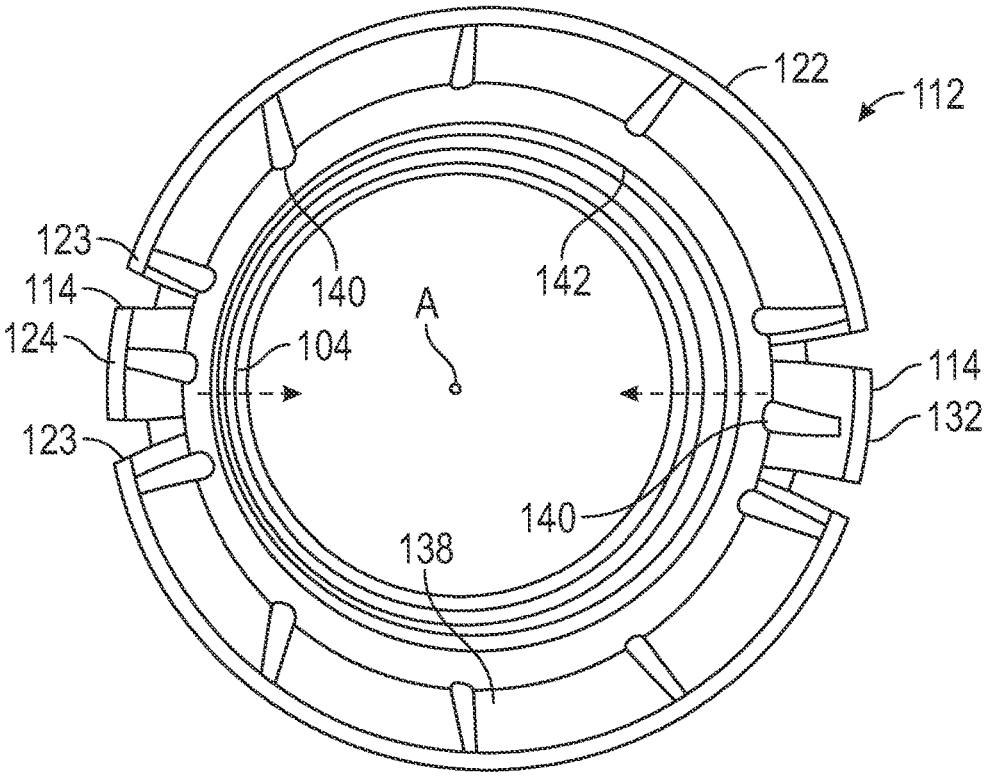
FIG. 3 is an end view of the connector end of FIG. 2.
Figure 4:
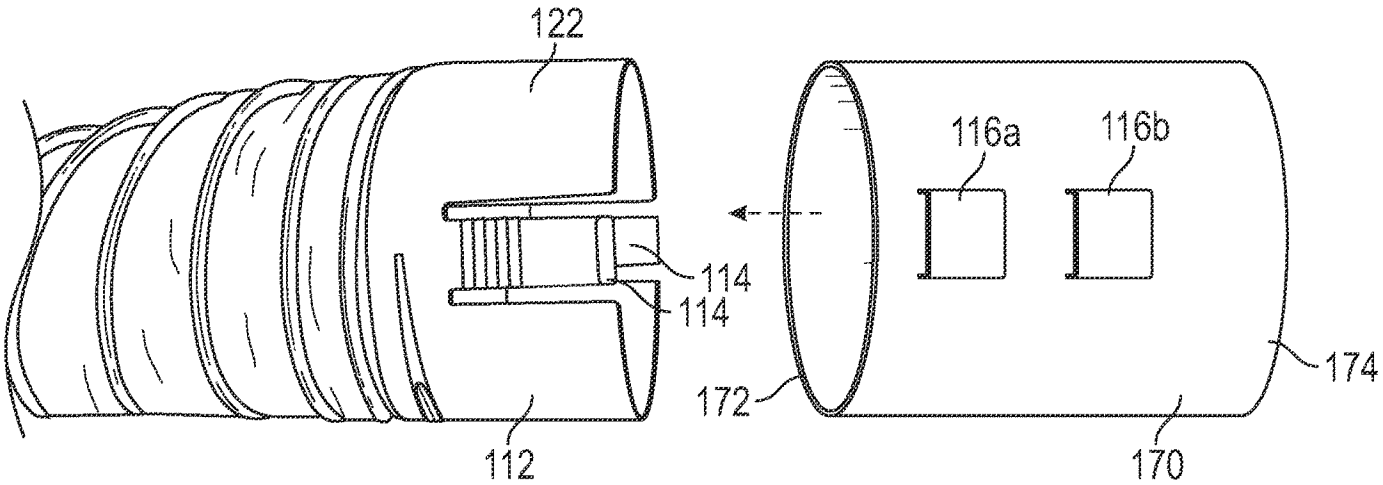
FIG. 4 is an unassembled, side view of the connector end of FIG. 2 and a linking connector.
Figure 5:
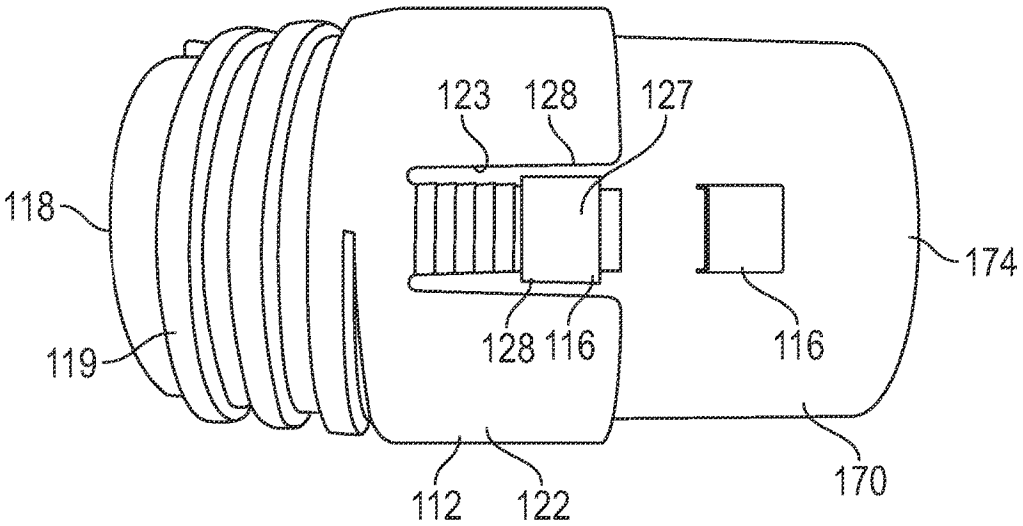
FIG. 5 is an assembled, side view of the connector end and linking connector of FIG. 4.
Figure 6:
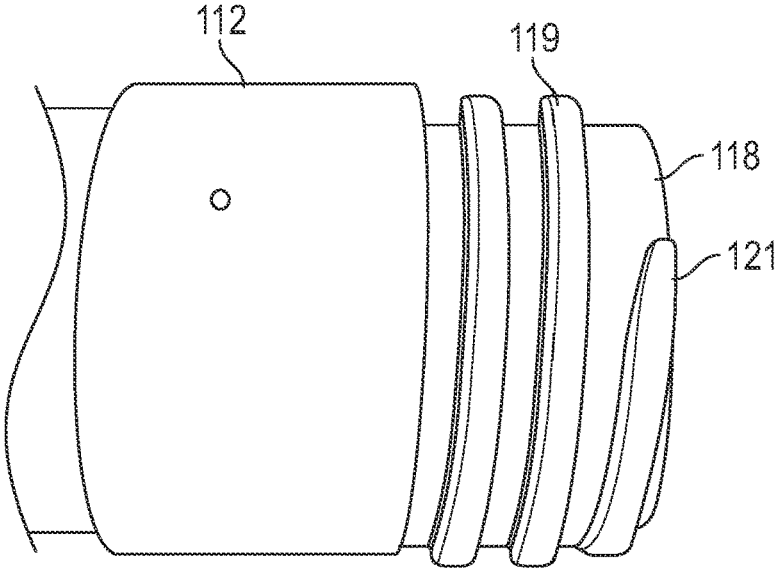
FIG. 6 is a top, side view of the connector end, showing the beginning of the threading.

Referring to FIGS. 2-6, the second end connector 112 is shown with the wire-reinforced core 104 threaded on a second end 118 of the connector end 112, which comprises threading 119 (best seen in FIGS. 5 and 6). Turing to FIG. 6, the connector end 112 is rotated to show the leading end 121 of the threading. As is understood, the threading has a pitch and thread angle suitable to receive the wire coil of the wire-reinforced core of a flex duct.

Figure 2:
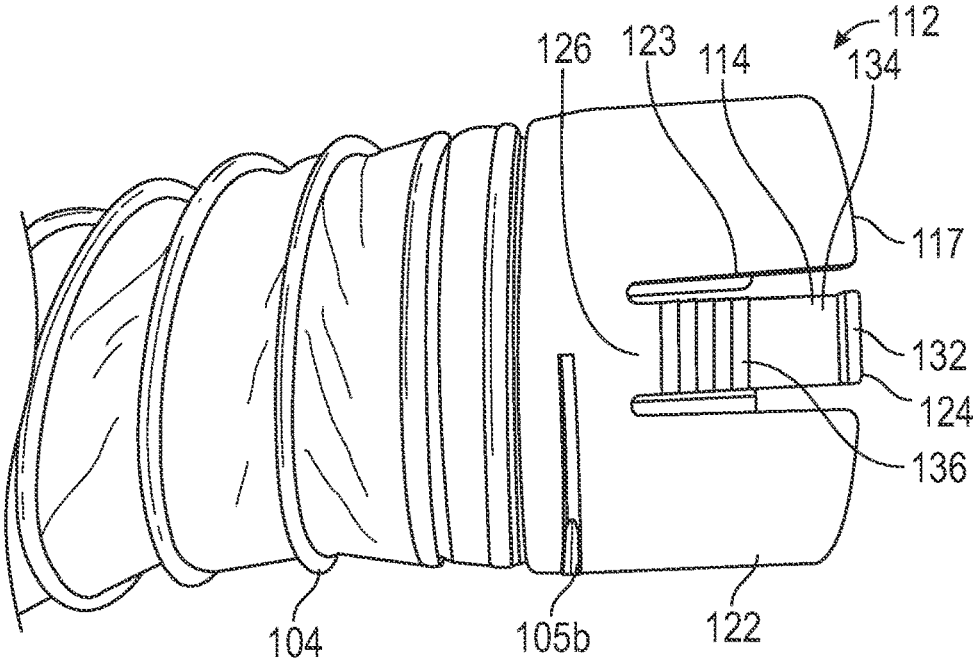
FIG. 2 is a side, perspective view of a connector end of the flex duct system having a wire-reinforced core of a flexible duct threaded thereon.

Turning again to FIGS. 2-3, the plurality of locking tabs 114 of the second end connector 112 (and likewise, the first end connector 110) partially define the body 122 thereof because of being separated therefrom by parallel slits 123 in the body 122. As best seen in FIG. 2, each of the plurality of locking tabs 114 has a free end 124 and a fixed end 126. The free end 124 forms a detent 132, and an arm potion 134 is immediately adjacent to the detent 132. The arm portion 134 is sized and shaped to fit inside one of the plurality of sleeves 116 after the detent 132 has passed through said sleeve 116. Each of the plurality of locking tabs 114 has a grip portion 136 most proximate the fixed end 126 and is configured to flex inward toward a central longitudinal axis (A) when pressure is applied to the grip portion 136 thereof, as represented by the dashed arrows in FIG. 3. As best seen in FIG. 3, the interior surface 138 of the body 122 of each of the first and second connector ends 110, 112 comprises a plurality of spaced apart longitudinal ribs 140 that terminate at an inward protruding shoulder 142. The boot 120, the saddle trunk 130, or the linking connector 150 are each insertable into either of the connector ends 110, 112 of the flex duct 102 until seated on the inward protruding shoulder 142. The longitudinal ribs 140 of the female receiving end 117 guide the male end 152, 162, 172 therein and provide a friction fit to hold the male end firmly therein to form a fluid tight conduit.

Turning now to FIGS. 4 and 5, the linking connector 170 is shown in an unassembled position and an assembled position, respectively, relative to a connector end 112. Each locking tab 114 is an elongate, generally rectangular shape, and each sleeve 116 is generally square bracket-shaped when viewed in a transverse cross-section or from an end view. When assembled, the top 127 of the sleeve 116 is seated on the arm portion 134 of the locking tab 114 and the sides 128 of the sleeve 116, one each, are received in the parallel slits 123. The linking connector 170 has a first end 172 and second end 174 and is a generally short conduit for connecting one connector end to another connector end 110, 112. The linking connector 170 has a first plurality of sleeves 116*a* most proximate the first end 172 and a second plurality of sleeves 116*b* most proximate the second end 174. As seen in FIG. 4, the sleeves 116*a*, 116*b* are aligned with one another in the direction of the longitudinal axis (A), but could be offset radially if desired.

Figure 7:
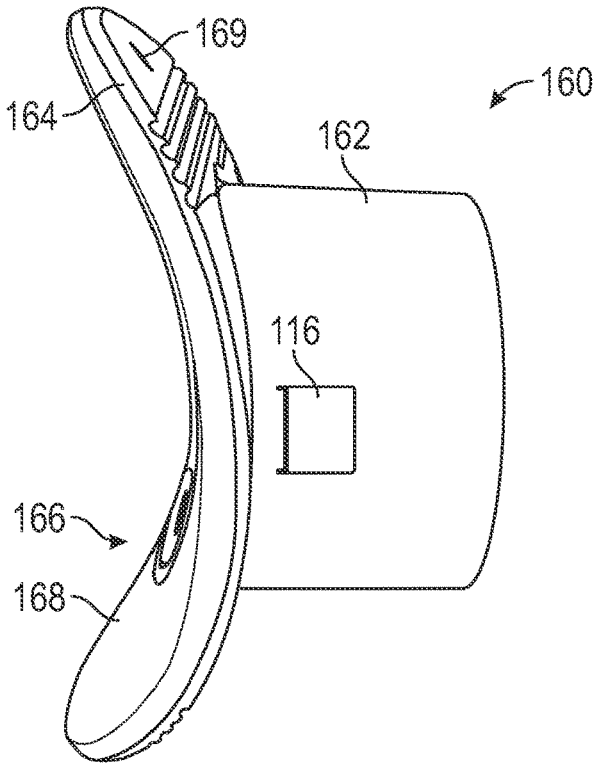
FIG. 7 is a side, perspective view of a trunk saddle connector.

Referring to FIG. 7, the saddle trunk 160 is shown from a side view to emphasize the curvature of the saddle flange 164 that extends radially outward from male end 162. The rear surface 166 of the saddle flange 164 is covered with a sealing material 168, such as a foam, rubber, and the like, that will form a fluid tight seal against an exterior surface of a cylindrical plenum, duct, or trunk 180 (shown in FIG. 1). The saddle flange 164 includes a plurality of boreholes 169 therethrough for receipt of a fastener 182 (FIG. 1) to fixedly attach the saddle trunk 160 to the cylindrical plenum, duct, or trunk 180, such that the saddle trunk 160 can come factory installed thereto.

Referring back to FIG. 1, the boot 150 can have an elbow 156 at any necessary angle to position a second end 154 as needed for a building. Typically, the boot 150 has a 90° elbow and the second end 154 defines a seat 158 to receive a vent 190. In one embodiment, the vent 190 is a vent insert slidably received inside the second end 154 of the boot 150.

In another aspect, kits containing any number and variety of the components described above are disclosed herein. In one embodiment, the kit includes one or more flex ducts, each having a wire-reinforced core with a first end and a second end, a plurality of hollow connector ends each having a threaded end configured to receive one of the first end and second end of the wire-reinforced core of a flex duct and a locking end having a plurality of locking tabs, and any number and combination of boots, saddle trunks, or linking connectors, each having a plurality of sleeves each protruding radially outward and positioned to releasably, attachably receive one of the plurality of locking tabs for a fluid tight connection. Each boot, saddle trunk, or linking connector is insertable into one of the connector ends of the flex duct until seated on an inward protruding shoulder within the respective hollow connector end.

Each saddle trunk can be fixed attached to a prefabricated trunk, plenum, or duct. Each boot can have a 90° elbow and comprises a vent insert. In all embodiments, the flex duct has an insulation layer juxtaposed to the wire-reinforced core and an outermost sheath.

The hollow connector ends are as described above. The plurality of locking tabs partially define the body of each of the first and second connector ends.

The kit can include a plurality of flex ducts of differing lengths and/or differing diameters. As such, the kit can include a plurality of end connectors of diameters that match the wore-reinforced core diameter of the flex ducts. The saddle trunk can have a concave back seated against a cylindrical trunk or duct having a matching convex curvature with a fluid tight seal. The kit can include a plurality of registers or vents insertable in a boot.

Method for installing a flex duct system are disclosed herein that include providing any one of the kits described herein, determining a length of the flex duct needed for connecting the flex duct to one of an installed boot or saddle trunk, selecting a flex duct having the length or cutting the flex duct to the length, threading a first end of the wire-reinforced core on to the first connector end, threading a second end of the wire-reinforced core on to the second connector end, and connecting the first connector end to the boot or saddle trunk and the second connector end to another boot, saddle trunk, or linking connector by sliding the first and second end connectors onto the boot, saddle trunk, or linking connector with the plurality of locking tabs inserted into the plurality of sleeves. Threading the first end of the wire-reinforced core on to the first connector end may occur before determining the length of the flex duct.

Although the invention is shown and described with respect to certain embodiments, it is obvious that modifications will occur to those skilled in the art upon reading and understanding the specification, and the present invention includes all such modifications.

What is claimed is:

1. A flex duct system comprising:

a flex duct having a wire-reinforced core and first and second hollow connector ends, wherein the wire-reinforced core comprises a wire coil having a first end and a second end threaded onto one each of the first and second hollow end connectors, respectively, and each of the first and second hollow connector ends has a plurality of locking tabs and the interior surface of the body of each of the first and second hollow connector ends comprises a plurality of spaced apart longitudinal ribs that terminate at an inward protruding shoulder;

a boot, a saddle trunk, or a linking connector having a plurality of sleeves each protruding radially outward and positioned to releasably, attachably receive one of the plurality of locking tabs for a fluid tight connection.

2. The system of claim 1, wherein the plurality of locking tabs partially define the body of each of the first and second connector ends.

3. The system of claim 1, wherein each of the plurality of locking tabs has a free end forming a detent and an arm potion immediately adjacent to the detent that is sized and shaped to fit inside one of the plurality of sleeves after the detent has passed through the one of the plurality of sleeves.

4. The system of claim 3, wherein each of the plurality of locking tabs has a grip portion most proximate a fixed end thereof.

5. The system of claim 4, wherein each of the plurality of locking tabs is configured to flex inward toward a central longitudinal axis when pressure is applied to the grip portion thereof.

6. The system of claim 1, wherein the boot, the saddle trunk, or the linking connector are each insertable into one of the connector ends of the flex duct until seated on the inward protruding shoulder.

7. The system of claim 1, wherein the linking connector has a first plurality of sleeves most proximate a first end thereof and a second plurality of sleeves most proximate a second end thereof.

8. The system of claim 1, wherein the saddle trunk is fixedly attached to a prefabricated trunk, plenum, or duct.

9. A kit comprising:

a flex duct having a wire-reinforced core with a first end and a second end and having an insulation layer juxtaposed to the wire-reinforced core and an outermost sheath, wherein the wire reinforced core comprises a wire coil having a first end and a second end;

first and second hollow connector ends each having a threaded end configured to receive one of the first end of the wire coil and the second end of the wire coil of the wire-reinforced core of the flex duct and each having a locking end having a plurality of locking tabs;

a boot, a saddle trunk, or a linking connector having a plurality of sleeves each protruding radially outward and positioned to releasably, attachably receive one of the plurality of locking tabs for a fluid tight connection.

10. The kit of claim 9, wherein the saddle trunk is fixedly attached to a prefabricated trunk, plenum, or duct.

11. The kit of claim 9, wherein the boot has a 90° elbow and comprises a vent insert.

12. The kit of claim 9, wherein the plurality of locking tabs partially define the body of each of the first and second connector ends.

13. The kit of claim 9, wherein each of the plurality of locking tabs has a free end forming a detent and an arm potion immediately adjacent to the detent that is sized and shaped to fit inside one of the plurality of sleeves after the detent has passed through the one of the plurality of sleeves.

14. The kit of claim 9, wherein each of the plurality of locking tabs has a grip portion most proximate a fixed end thereof.

15. The kit of claim 14, wherein each of the plurality of locking tabs is configured to flex inward toward a central longitudinal axis when pressure is applied to the grip portion thereof.

16. The kit of claim 15, wherein the interior surface of the body of each of the first and second connector ends comprises a plurality of spaced apart longitudinal ribs that terminate at an inward protruding shoulder, and the boot, the saddle trunk, or the linking connector are each insertable into one of the connector ends of the flex duct until seated on the inward protruding shoulder.

17. Method for installing a flex duct system, the method comprising:

providing a kit according to claim 9;

determining a length of the flex duct needed for connecting the flex duct to one of an installed boot or saddle trunk;

cutting the flex duct to the length;

threading a first end of the wire-reinforced core on to the first connector end;

threading a second end of the wire-reinforced core on to the second connector end; and connecting the first connector end to the boot or saddle trunk and the second connector end to another boot, saddle trunk, or linking connector by sliding the first and second end connectors onto the boot, saddle trunk, or linking connector with the plurality of locking tabs inserted into the plurality of sleeves.

18. The method of claim 17, wherein threading the first end of the wire reinforced core on to the first end connector occurs before determining a length of the flex duct.

* * * * *